US006345754B1

(12) United States Patent
Jeng

(10) Patent No.: US 6,345,754 B1
(45) Date of Patent: Feb. 12, 2002

(54) STAPLE MAGAZINE FOR STAPLER

(76) Inventor: Lih-Rong Jeng, PO Box 82-144, Taipei (TW)

( * ) Notice: Subject to any disclaimer, the term of this patent is extended or adjusted under 35 U.S.C. 154(b) by 0 days.

(21) Appl. No.: 09/848,223

(22) Filed: May 4, 2001

(51) Int. Cl.[7] ..... B25C 5/16
(52) U.S. Cl. ..... 227/109; 227/120
(58) Field of Search ..... 227/109, 119, 227/120, 134

(56) References Cited

U.S. PATENT DOCUMENTS 3,958,738 A * 5/1976 Tremblay ..... 227/109
4,556,161 A * 12/1985 Oide ..... 227/120
4,732,309 A * 3/1988 Judge ..... 227/109
5,695,108 A * 12/1997 Lee ..... 227/120
5,794,832 A * 8/1998 Chen ..... 227/109
5,967,397 A * 10/1999 Fealey ..... 227/109

* cited by examiner

*Primary Examiner*—Scott A. Smith
(74) *Attorney, Agent, or Firm*—A & J

(57) ABSTRACT

A staple magazine for stapler including an elongated outer casing, an elongated inner casing fixedly mounted inside the outer casing and defining with the outer casing two staple guide grooves, and a top cover plate covered on the outer casing, the guide grooves having different widths for enabling the staple magazine to carry staples/nails of different sizes, the top cover plate having a ridged top wall fitting ridged staples, one upright sidewall of the inner casing having a longitudinally extended protruded portion of smoothly arched cross section protruding toward the other upright sidewall of the inner casing and serving as a guide rail to work with one of the guide grooves for carrying U-nails.

1 Claim, 3 Drawing Sheets

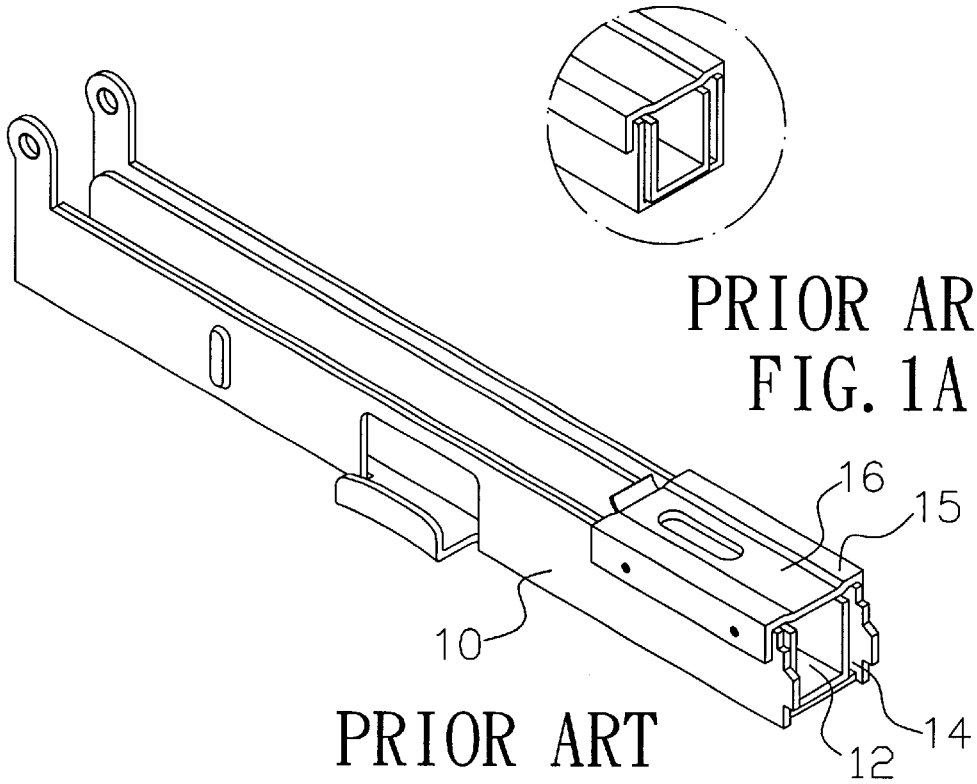
PRIOR ART
FIG. 1A
PRIOR ART
FIG. 1
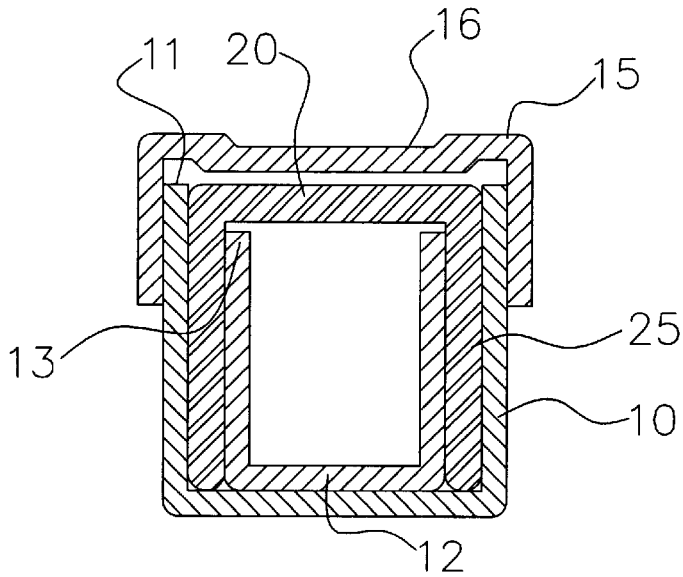
PRIOR ART
FIG. 2

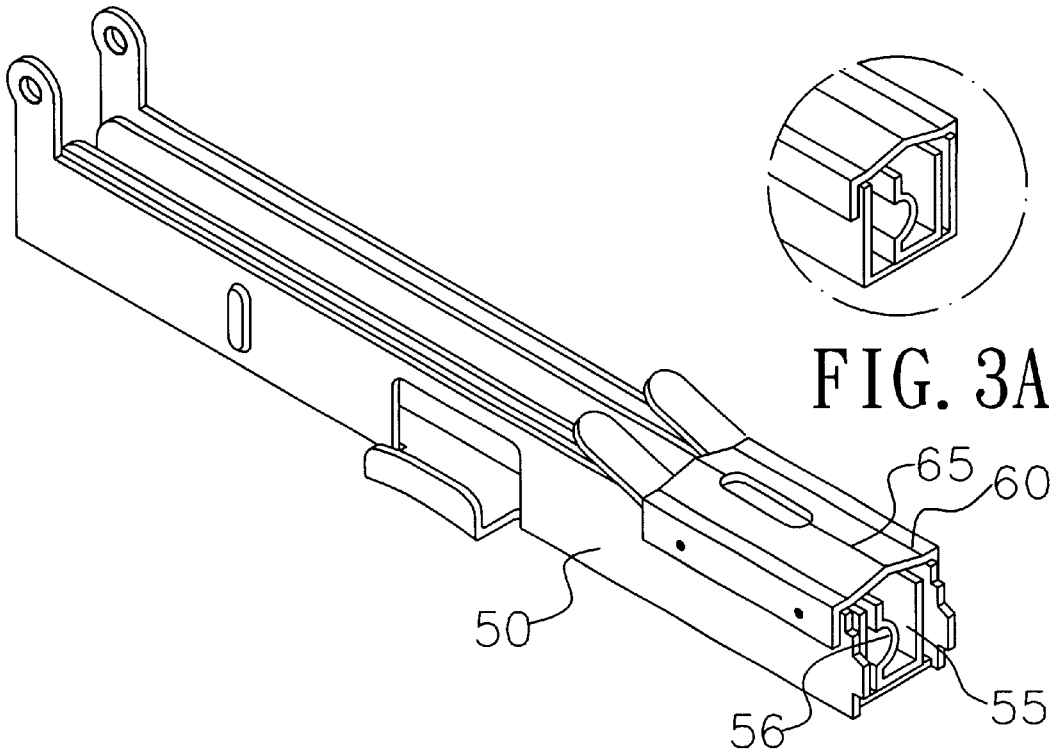
FIG. 3A
FIG. 3
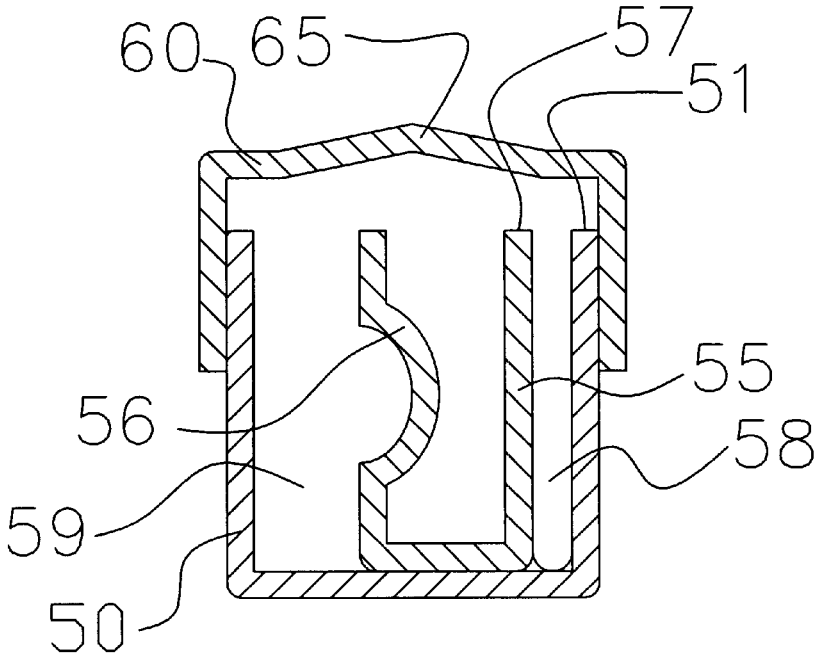
FIG. 4

STAPLE MAGAZINE FOR STAPLER

BACKGROUND OF THE INVENTION

The present invention relates to staplers and, more specifically, to a staple magazine for stapler, which fits staples/nails of different designs and sizes.

A variety of staplers have been disclosed for fastening papers, etc. with ∏-staples, ridged staples, U-nails, T-nails, I-nails. However, conventional staplers are designed for use with a particular size of staples/nails. Every user may have to prepare staplers of different sizes and different models for use with different staples/nails. FIGS. 1, 1A and 2 show a staple magazine for stapler according to the prior art. As illustrated, this structure of staple magazine comprises an elongated outer casing 10 of substantially U-shaped cross section, an elongated inner casing 12 of substantially U-shaped cross section fixedly mounted inside the outer casing 10 and defining with the outer casing 10 two longitudinally extended guide grooves 14 of equal width adapted to receive the legs of staples 25, and a top cover plate 15 covered on the top of the front part of the outer casing 10. The topmost edge 13 of the inner casing 12 is disposed below the elevation of the topmost edge 11 of the outer casing 10. The top cover plate 15 has a recessed middle part 16. This design of staple magazine is suitable for use with ∏-staples of a particular size only.

SUMMARY OF THE INVENTION

The present invention has been accomplished to provide a staple magazine for stapler, which eliminates the aforesaid problem. It is one object of the present invention to provide a staple magazine for stapler, which fits different staples and nails of different sizes. It is another object of the present invention to provide a staple magazine for stapler, which is easy and inexpensive to manufacture. According to one aspect of the present invention, the upright sidewalls of the inner casing and upright sidewalls of the outer casing have the respective topmost edge disposed at the same elevation. According to another aspect of the present invention, the two guide grooves defined between the upright sidewalls of the inner casing and the upright sidewalls of the outer casing have different widths, for enabling the staple magazine to fit staples/nails of different sizes. According to still another aspect of the present invention, the top cover plate has a ridged top wall fitting ridged staples. According to still another aspect of the present invention, one upright sidewall of the inner casing has a longitudinally extended protruded portion of smoothly arched cross section protruding toward the other upright sidewall of the inner casing and serving as guide rail means to work with one of the guide grooves for carrying U-nails.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 1 illustrates a staple magazine according to the prior art.

FIG. 1A is a sectional view of a portion of FIG. 1;

FIG. 2 is a cross-sectional view of the prior art staple magazine.

FIG. 3 illustrates a staple magazine according to the present invention.

FIG. 3A is a sectional view of a portion of FIG. 3.

FIG. 4 is a cross sectional view of the present invention.

DETAILED DESCRIPTION OF THE PREFERRED EMBODIMENT

Figure 5A:
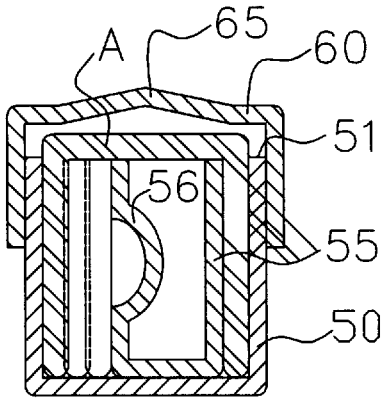
FIG. 5A shows an application example of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Referring to FIGS. 3 and 3A a staple magazine is shown comprising an outer casing 50, an inner casing 55, and a top cover plate 60. The inner casing 55 is fixedly fastened to the bottom wall of the outer casing 50 on the inside. The top cover plate 60 is covered on the top of the front part of the outer casing 50.

Referring to FIG. 4 and FIG. 3 again, the outer casing 50 is an elongated, rectangular open frame having a horizontal flat bottom wall and two upright sidewalls at two opposite lateral sides of the horizontal flat bottom wall. The upright sidewalls of the outer casing 50 have a respective shoulder (the topmost edge) 51 disposed at the same elevation. The inner casing 50 is an elongated, rectangular open frame longitudinally fixedly fastened to the top surface of the horizontal flat bottom wall of the outer casing 50 near one lateral side, having two upright sidewalls defining with the two upright sidewalls of the outer casing 50 two longitudinal grooves of different widths at two sides, namely, the guide groove 58 of width equal to the wall thickness of staples, and the adjustment groove 59 of width greater than the guide groove 58 (see FIGS. 5A and 5B). Because the inner casing 55 define with the outer casing 50 two parallel grooves 58 and 49 of different widths, the staple magazine is suitable to carry staples of different sizes (see FIGS. 5A and 5B). The upright sidewalls of the inner casing 55 have a respective shoulder (the topmost edge) 57 disposed in flush with the shoulder 51 of each of the upright sidewalls of the outer casing 50. One upright sidewall of the inner casing 55, which is disposed adjacent to the adjustment groove 59, has a longitudinally extended protruded portion of smoothly arched cross section 56 protruding toward the other upright sidewall of the inner casing 55 and serving as a guide rail to work with the guide groove 58 for carrying U-nails C (see FIG. 5C). The top cover plate 60 is welded to the two upright sidewalls of the outer casing 50, having a middle ridged top wall 65 fitting ridged staples B (see FIG. 5B).

Figure 5B:
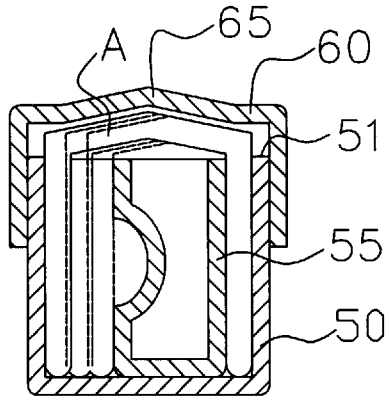
FIG. 5B shows another application example of the present invention.
Figure 5C:
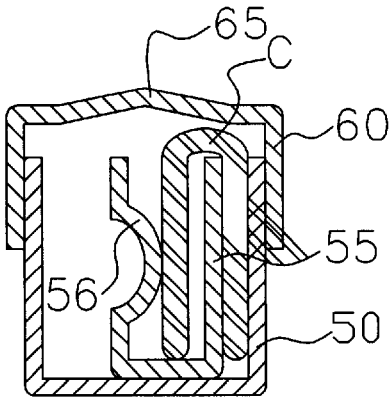
FIG. 5C shows still another application example of the present invention.
Figure 5D:
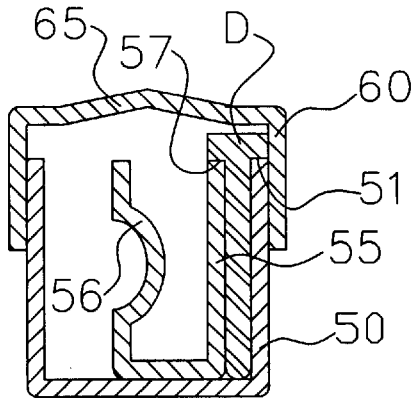
FIG. 5D shows still another application example of the present invention.
Figure 5E:
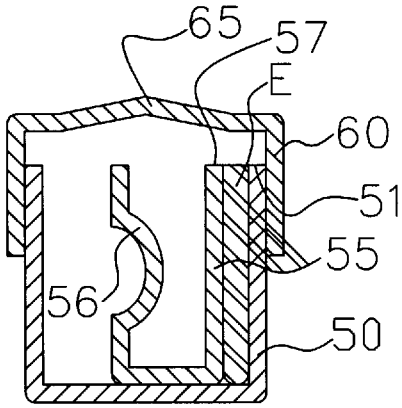
FIG. 5E shows still another application example of the present invention.

A staple magazine constructed according to the present invention is capable of carrying regular staples A on the inner casing 55 with one leg of each staple A engaged into the guide groove 58 and the other leg of each staple A supported in the adjustment groove 59 (see FIG. 5A). Because the adjustment groove 59 is wider than the thickness of the legs of the staples A, staples of different sizes can be loaded in the staple magazine. The ridged design 65 of the top cover plate 60 enables the staple magazine to carry ridged staples B of different sizes (see FIG. 5A). The smoothly arched cross section 56 of the inner casing 55 serves as a guide rail to work with the guide groove 58 for enabling the staple magazine to carry U-nails C (see FIG. 5C). T-nails D can also be carried in the staple magazine. In this case, the T-nails D are put in the guide groove 58 with the head of each T-nail D respectively supported on the shoulder 51 of one upright sidewall of the outer casing 50 and the shoulder 57 of one upright sidewall of the inner casing 55 (see FIG. 5D). The staple magazine can also be used with I-nails E. In this case, I-nails E are directly put in the guide groove 58 (see FIG. 5E).

A prototype of staple magazine has been constructed with the features of the annexed drawings. The staple magazine functions smoothly to provide all of the features discussed earlier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A staple magazine for stapler comprising an elongated outer casing, said elongated outer casing having a horizontal bottom wall and two upright sidewalls at two opposite lateral sides of the horizontal bottom wall of said elongated outer casing, an elongated inner casing mounted inside said elongated outer casing, said elongated inner casing comprising a horizontal bottom wall fixedly fastened to the horizontal bottom wall of said elongated outer casing and two upright sidewalls at two opposite lateral sides of the horizontal bottom wall of said elongated inner casing, the upright sidewalls of said elongated inner casing defining with the upright sidewalls of said elongated outer casing two longitudinally extended grooves adapted to guide staples/nails, and a top cover plate fixedly fastened to the upright sidewalls of said elongated outer casing at a top side and covered over a front part of said elongated outer casing, wherein said guide grooves have different widths for enabling the staple magazine to carry staples/nails of different sizes; said top cover plate has a ridged top wall fitting ridged staples; the upright sidewalls of said elongated inner casing and the upright sidewalls of said elongated outer casing have the respective topmost edge disposed at the same elevation; one upright sidewall of said elongated inner casing has a longitudinally extended protruded portion of smoothly arched cross section protruding toward the other upright sidewall of said elongated inner casing and serving as guide rail means to work with one of said guide grooves for carrying U-nails.

* * * * *